United States Patent [19]

Beduhn et al.

[11] 4,382,519

[45] May 10, 1983

[54] TRAVELING ATTACHMENT FOR RING SUPPORTED LIFT CRANE

[75] Inventors: Daniel E. Beduhn; James G. Morrow, Sr., both of Manitowoc, Wis.

[73] Assignee: The Manitowoc Company, Inc., Manitowoc, Wis.

[21] Appl. No.: 305,519

[22] Filed: Sep. 25, 1981

Related U.S. Application Data

[63] Continuation of Ser. No. 222,696, Jan. 5, 1981, abandoned, which is a continuation-in-part of Ser. No. 58,285, Jul. 17, 1979, abandoned.

[51] Int. Cl.[3] ..... B66C 23/78; B66C 23/73

[52] U.S. Cl. ..... 212/195; 212/189; 280/402; 280/415 R

[58] Field of Search ..... 212/182–183, 212/188–189, 195, 198, 223–224, 232, 237–238, 245, 247–248, 254–255; 280/402, 415 R

[56] References Cited

U.S. PATENT DOCUMENTS

| | | | |
|---|---|---|---|
| 3,842,984 | 10/1974 | Brown et al. | 212/198 |
| 3,868,022 | 2/1975 | Greenlay et al. | 180/140 X |
| 3,878,944 | 4/1975 | Beduhn et al. | 212/189 |
| 4,020,952 | 5/1977 | Scodino | 212/189 |
| 4,042,115 | 8/1977 | Beduhn et al. | 212/178 |
| 4,196,816 | 4/1980 | Dvorsky et al. | 212/195 |

FOREIGN PATENT DOCUMENTS

| | | | |
|---|---|---|---|
| 1436263 | 3/1966 | France | 212/195 |

*Primary Examiner*—Trygve M. Blix
*Assistant Examiner*—R. B. Johnson
*Attorney, Agent, or Firm*—Leydig, Voit, Osann, Mayer & Holt, Ltd.

[57] ABSTRACT

A traveling attachment including a pair of crawler assemblies and frame elements are provided for interconnection to the ring of a ring supported crane so the crane can travel under load. The crawler assemblies may be pivotally mounted and reversely powered to facilitate turning.

4 Claims, 2 Drawing Figures

TRAVELING ATTACHMENT FOR RING SUPPORTED LIFT CRANE

CROSS-REFERENCE TO RELATED APPLICATIONS

This application is a continuation of Ser. No. 222,696 filed Jan. 5, 1981, now abandoned, which is a continuation-in-part of Ser. No. 058,285 filed July 17, 1979, now abandoned each of said applications are incorporated by reference.

BACKGROUND OF THE INVENTION

This invention relates generally to lift cranes and more particularly concerns a traveling attachment for ring supported cranes.

In response to ever-increasing user needs, self-propelled cranes have been made capable of lifting ever greater loads. While a number of factors enter into determining crane capacity, a basic limitation arises from the fact that, inevitably, the weight of the crane and its load must be transferred to the earth in some stable fashion, and, if rotation of the load is desired, the crane-earth connection must be made stable through the arc of crane rotation.

A significant increase in crane capacity was achieved by providing a self-propelled crane with the support ring and extended boom carrier disclosed and claimed in U.S. Pat. Nos. 3,485,383 and 3,878,944, assigned to the assignee of the present invention. In this design, the weight of the crane and its load is transferred to the ground through a large diameter, track-like ring. As shown in these patents, and as practiced commercially for some years, the support ring is either blocked into place by timbers fitted and wedged beneath and completely around the ring or is supported by a plurality of jacks spaced around the periphery of the ring.

SUMMARY AND OBJECTS OF INVENTION

The primary aim of the present invention is to provide an attachment which permits such a ring supported crane to travel under load.

It is also an object of the invention to provide a traveling attachment as characterized above that can rapidly be set up for crane operation so as to increase the mobility of a crane using the track-like ring support.

Other objects and advantages of the invention will become apparent upon reading the following detailed description and upon reference to the drawings, in which:

Figure 1:
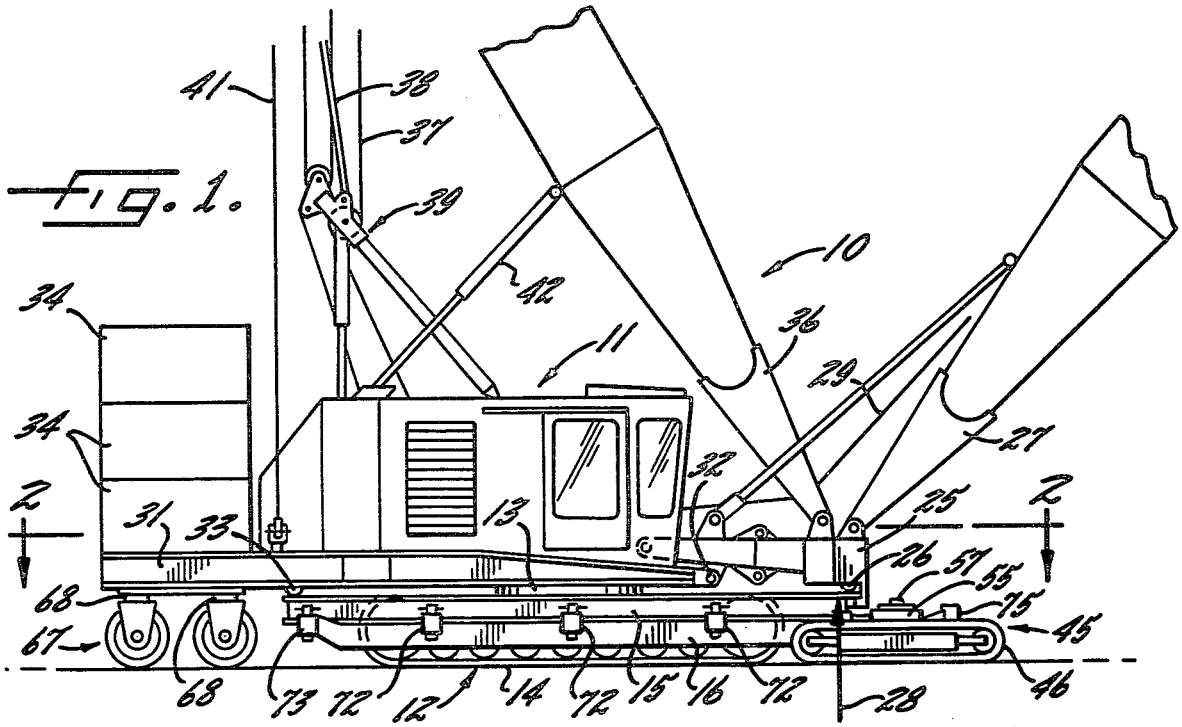
FIG. 1 is a fragmentary elevation of a crane support structure embodying the present invention.
Figure 2:
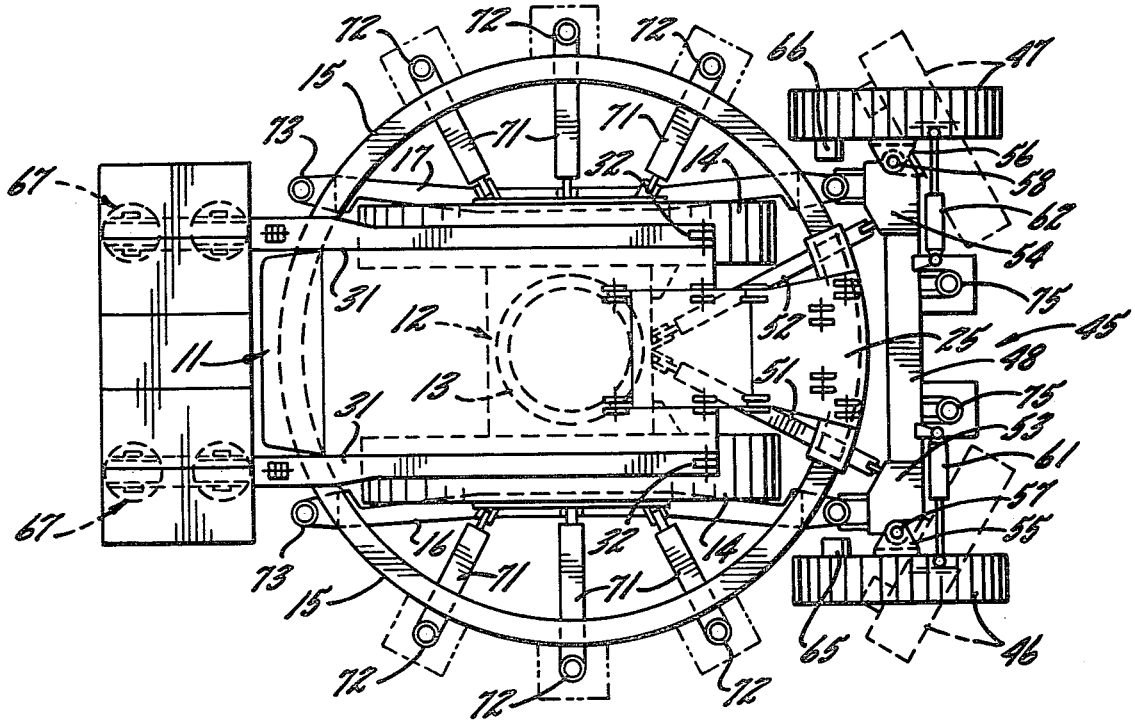
FIG. 2 is a section taken approximately along the line 2—2 in FIG. 1.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

DESCRIPTION OF PREFERRED EMBODIMENT

Turning to the drawing, there is shown a crane 10 having an upper structure 11 mounted for rotation on a car body 12 through a roller path 13. The crane 10 is normally mobile and, for moving over the ground, crawler assemblies 14 form part of the car body 12.

In order to increase the capacity of the crane 10, a track-like ring 15 is secured to the ends of support beams 16 and 17 so as to horizontally surround the car body 12. Preferably, the ring has an I-beam cross section with a hardened upper path surface. To adapt the crane for this ring support configuration, the support beams 16, 17 are secured to the car body 12 running outboard and parallel to the crawler assemblies 14 so that the beams become part of the car body.

The geometry of the crane 10 contributes to its high capacities when used with the ring support. A boom carrier 25 is pivoted for vertical movement on the upper structure 11 and provided with a roller assembly 26 for rotation on the ring 15. A boom 27 is mounted on the carrier at what becomes the load lifting fulcrum 28 of the system, and a load lift line 29 runs along and over the end of the boom 27. A counterweight carrier 31 is also pivoted for vertical movement at 32 on the upper structure 11 and the carrier extends the opposite direction from the boom carrier 25 to ride on the ring 15 through roller assemblies 33, only one of which is shown. Counterweights 34 are stacked on the carrier 31.

In effect, all structure to the non-boom side of the fulcrum 28 is available for counterbalancing and stabilizing the crane 10. Preferably, a mast 36 is mounted on the carrier 25 and boom lift rigging 37 interconnects the tops of the mast 36 and the boom 27 for moving the boom vertically. The mast 36 is secured by pendants 38 to gantry structure 39 on the upper structure 11 to form a substantially rigid assembly, and other pendants 41 provide substantially rigid connections between the counterweight carrier 31 and the top of the mast 36. Struts 42 establish the substantially fixed angular position to the mast 36. This geometry creates a stable, high capacity crane.

In accordance with the present invention, a traveling support attachment 45 is provided for supporting the ring 15 under the fulcrum 28 to permit movement of the crane 10 and ring 15 over the ground while the boom 27 is lifting a heavy load. In the preferred embodiment the traveling support attachment 45 includes a pair of laterally spaced crawler assemblies 46 and 47 respectively located adjacent the forward ends of the support beams 16 and 17. The crawler assemblies 46, 47 are connected together by a frame element 48 which, in turn, is interconnected from adjacent its ends to the car body 12 by a pair of frame elements 51 and 52 on which the ring 15 is supported. Preferably, the frame elements 51, 52 are pin connected to the car body 12 and project forwardly in diverging relation between the lateral support beams 16, 17 where they are connected to the frame element 48.

When a heavy load is lifted by the boom 27, the forces are transmitted down through the boom 27 and mast 36 to the boom carrier 25 riding on the ring 15 adjacent the fulcrum 28. The lifting forces are also transmitted through pendants 41 to the counterweights 34 stacked on the carrier 31 tending to lift the carrier 31 off the ring 15. Since the attachment frame elements 51, 52 support the ring 15 adjacent the fulcrum 28, the lifting forces pass primarily down through the ring 15 to the attachment assembly and are resisted by the crawler assemblies 46, 47 engaging the ground. If it is desired to travel with a load, power may be applied to the main crawler assemblies 14 and the crane 10 and ring 15 may be "walked" ahead with the load being primarily supported by the traveling support attachment 45 and its crawler assemblies 46, 47. Of course, the crane 10 may also be traveled rearwardly under load by reversing the direction of movement of the main crawlers 14.

In keeping with a further aspect of the invention, the crawler assemblies 46, 47 are preferably pivotally mounted to reinforced end portions 53, 54 of the frame 48 by yoke elements 55 and 56 and vertical pivot posts 57 and 58, respectively. Additionally, hydraulic cylinders 61 and 62 are provided interconnecting the frame end portions 53, 54 and the crawler assemblies 46, 47 to permit turning the crawler assemblies 46, 47 and thus facilitate moving the crane 10 under load about a curved path.

While the crawler assemblies 45, 46 need not be independently powered for most applications, the mobility and maneuverability of the crane 10 traveling under load may be further enhanced by selectively and reversibly powering the crawlers 45, 46 such as by independent hydraulic motors 65 and 66, respectively. Operation of these motors 65, 66 not only increases the traction power of the crane 10, since the load is primarily supported on the crawlers 45, 46, but also, insures more positive steering control when the crane is moved in a curved path.

Pursuant to another aspect of the invention, the counterweight carrier 31 may be provided with wheeled support means 67 to resists rearward tipping of the crane 10 and ring 15 when a heavy load is not being supported by the boom 27. This avoids the necessity of removing portions of the counterweight 34 from the carrier between successive heavy lift operations. Preferably, the wheeled support means 67 are pivotally mounted to the counterweight carrier about substantially vertical axis such as pivot posts 68 so that the wheels may caster as the crane 10 turns either during swinging or traveling movement.

It should also be appreciated that the traveling support attachment 45 and/or the wheeled support means 67 may be quickly and conveniently attached and detached from a standard ring supported crane such as disclosed in U.S. Pat. No. 3,878,944 which is incorporated herein by reference. As shown in that patent, a plurality of ring support arms 71 are pivoted for vertical movement on the car body 12 and extend outwardly to underlie the ring 15 at spaced points around the ring periphery. A plurality of jacks 72 are positioned one at the end of each of the arms 71 with the jacks 72 being sized so as to engage the ground when extended and lift the ring 15, the car body 12 and the crawler assemblies 14 from the ground.

To facilitate setting up the ring 15, hydraulic jacks 73 are mounted at the four ends of the support beams 16, 17. Manipulation of these jacks 73 allows the ring 15 to be lifted and leveled, whereupon the manual jacks 72 can be quickly extended to provide firm support for the ring completely around its periphery and to facilitate coupling and uncoupling the traveling support attachment 45 and/or the wheeled support means 67.

If it is desired to move a heavy load from a forward position to a lateral position, or vice-versa, jacks 75 attached to the beam 48 may b energized and the crawler assemblies 46, 47 may be turned in to positions substantially tangential to the ring 15. This permits the entire ring-crane assembly to walk around its own center.

We claim as our invention:

1. In a crane having an upper structure pivoted on a lower carbody including crawler means for moving the crane over the ground, the combination comprising, a pair of support beams secured to and forming a part of said lower carbody, a track-like ring secured to said beams and horizontally surrounding said lower carbody and said crawler means, said beams extending fore and aft beneath and beyond the periphery of said ring, a boom carrier pivoted for vertical movement on said upper structure and riding for rotation on said ring, a boom mounted on said boom carrier for lifting a load, a counterweight carrier pivoted for vertical movement on said upper structure and riding for rotation on said ring, means interconnecting said counterweight carrier and said boom for counteracting a heavy load, and a traveling support attachment including a pair of laterally spaced crawler assemblies respectively attached outboard of said ring to the forward ends of said pair of beams by means including a cross frame interconnecting said crawler assemblies and a plurality of frame elements interconnecting said crawler assemblies and said lower carbody, said crawler assemblies are connected to said frame elements through vertical pivot posts, means for pivoting said crawler assemblies about the axis of said posts, and said cross frame including jack means mounted thereon to support said ring and to permit movement of said crane and ring over the ground while said boom is lifting a heavy load.

2. The combination of claim 1 wherein said crawler assemblies each include an endless track and hydraulic motor means provided for selectively and reversibly driving said tracks.

3. The combination of claim 1 wherein said counterweight extends outboard of said ring and movable support means are provided under said counterweight carrier outboard of said ring.

4. The combination of claim 3 wherein said movable support means are pivotally mounted under said counterweight carrier about substantially vertical axes.

* * * * *